US008196365B2

(12) United States Patent
Parshad

(10) Patent No.: US 8,196,365 B2
(45) Date of Patent: Jun. 12, 2012

(54) MODULAR WALL SYSTEM AND CONNECTION

(75) Inventor: David Parshad, Markham (CA)

(73) Assignee: Inscape Corporation, Holland Landing, Ontario (CA)

( * ) Notice: Subject to any disclaimer, the term of this patent is extended or adjusted under 35 U.S.C. 154(b) by 0 days.

(21) Appl. No.: 12/925,778

(22) Filed: Nov. 1, 2010

(65) Prior Publication Data

US 2011/0302867 A1 Dec. 15, 2011

(30) Foreign Application Priority Data

Jun. 10, 2010 (CA) ..... 2707256

(51) Int. Cl.
*E04H 1/00* (2006.01)

(52) U.S. Cl. ..... 52/239; 52/582.2; 52/783.1

(58) Field of Classification Search ..... 52/239, 52/270, 582.2, 584.1, 783.1, 238.1, 240
See application file for complete search history.

(56) References Cited

U.S. PATENT DOCUMENTS

| | | | | |
|---|---|---|---|---|
| 2,495,862 | A | 1/1950 | Osborn | |
| 2,891,638 | A | 6/1959 | Grundy | |
| 2,999,568 | A * | 9/1961 | Ludwig et al. | 52/584.1 |
| 3,037,593 | A * | 6/1962 | Webster | 52/476 |
| 3,048,244 | A | 8/1962 | Callahan | |
| 3,066,770 | A | 12/1962 | Millard | |
| 3,300,899 | A | 1/1967 | Haws | |
| 3,332,190 | A * | 7/1967 | Ekstrom | 52/464 |
| 3,353,318 | A | 11/1967 | Bacher | |
| 3,367,076 | A | 2/1968 | O'Brien | |
| 3,423,892 | A | 1/1969 | Rimington | |
| 3,453,790 | A | 7/1969 | Harris | |
| 3,707,060 | A | 12/1972 | Jansen, Jr. | |
| 3,778,939 | A | 12/1973 | Nelsson | |
| 3,803,787 | A | 4/1974 | Daggy | |
| 3,817,011 | A | 6/1974 | Weed | |
| 3,830,027 | A | 8/1974 | Paisley | |
| 4,037,380 | A | 7/1977 | Pollock | |
| 4,109,430 | A | 8/1978 | Fuller | |
| 4,186,539 | A | 2/1980 | Harmon | |
| 4,231,197 | A | 11/1980 | Caplan | |
| 4,700,517 | A | 10/1987 | Stohr | |
| 4,743,485 | A | 5/1988 | Ting | |
| 4,744,185 | A | 5/1988 | Lamberet | |
| 5,007,222 | A | 4/1991 | Raymond | |
| 5,010,702 | A | 4/1991 | Daw | |
| 5,140,792 | A | 8/1992 | Daw | |
| 5,228,257 | A | 7/1993 | Bowersox | |
| 5,272,850 | A | 12/1993 | Mysliwiec | |
| 5,274,979 | A | 1/1994 | Tsai | |
| 5,293,728 | A | 3/1994 | Christopher | |
| 5,373,678 | A | 12/1994 | Hesser | |

(Continued)

*Primary Examiner* — William Gilbert
*Assistant Examiner* — Gisele Ford
(74) *Attorney, Agent, or Firm* — Riches, McKenzie & Herbert LLP

(57) ABSTRACT

A construction of an upright panel unit adapted for use in a wall with the panel units abutting end to end in which a pair of spaced facing sheet members on either side of the panel unit have vertical edge portions joined at each end of the panel unit by being sandwiched between an inner bracket member and an outer bracket member, with the outer bracket member having male and female arms engageable and disengageable with an outer bracket member of the end of an adjacent panel unit merely by respective movement of the panel units longitudinally relative to each other.

12 Claims, 18 Drawing Sheets

U.S. PATENT DOCUMENTS 5,537,795 A * 7/1996 Dias ..... 52/586.2
5,613,338 A 3/1997 Esposito
5,664,386 A 9/1997 Palmersten
5,673,524 A 10/1997 Gailey
5,755,066 A 5/1998 Becker
5,855,100 A 1/1999 Hsueh
6,052,958 A * 4/2000 Miedema et al. ..... 52/284
6,122,879 A 9/2000 Montes
6,279,287 B1 8/2001 Meadows
6,834,468 B1 12/2004 Kroie
6,944,993 B1 * 9/2005 Jilk et al. ..... 52/36.1
7,377,082 B1 5/2008 Edwards
7,614,199 B2 11/2009 Smalley, III

* cited by examiner

MODULAR WALL SYSTEM AND CONNECTION

SCOPE OF THE INVENTION

This invention relates to panel constructions and, more particularly, to a construction for coupling the ends of demountable metal panel units for dividing interior space in a building.

Demountable panel constructions are known for dividing interior spaces in a building such as those disclosed in U.S. Pat. No. 3,066,770 to Millard issued Dec. 4, 1962, U.S. Pat. No. 3,803,027 to Paisley et al issued Aug. 20, 1974 and U.S. Pat. No. 5,010,702 to Daw et al issued Apr. 30, 1991, the disclosures of which are incorporated herein by reference. Such panel constructions are typically used to provide interior walls in buildings and employ individual upright panel units made up from a pair of facing metal sheet members optionally with an interior core between the facing sheet members spacing and supporting the facing sheet members. The panel units are typically installed in the panel construction arranged in an abutting relationship end-to-end typically with a vertical joint between the ends of two abutting panel units. In some cases, however, the panel units may be separated by vertical connecting posts either in line or where a corner is to be formed.

Typically, the lower edges of the panel units are supported by the floor of the building via a height adjusting levelling arrangement such as feet mounted on threaded posts. Typically, a floor track assembly is mounted on the floor within which the lower edges of the panel unit are received and a head track assembly is mounted to the ceiling within which the upper edges of the panel units are received. Oftentimes, a panel unit is mounted by being lifted upwardly into a channel forming the head track assembly sufficiently that the lower edge of the panel unit clears the base track assembly and then can be slid downwardly into the base track assembly. Oftentimes, the floor track assembly may comprise two bracket members which can be installed on either side of the lower portion of the panel unit after the panel unit has been located in place and engaged within the head track assembly mounted to the ceiling.

Various arrangements and configurations are known for the ends of the panel units which permit end-to-end coupling of the panel units and/or coupling of the end of a panel unit to a complementary vertical post. Known prior art arrangements for coupling the panel units end-to-end include vertically extending clips provided on each side of the panel units which engages flanges at the end of each abutting panel unit and serves to clip the flanges together against movement. Such arrangements suffer the disadvantage that separate clips are required, that the clips are visible from the sides of the panels, and that a gap is required between the sheet members of the abutting panel units.

SUMMARY OF THE INVENTION

To at least partially overcome these disadvantages of previously known devices, the present invention provides an advantageous configuration for the ends of panel units which accommodates joining the facing sheet members on the panel unit together at each end and permits a simplified coupling of the panel unit to an adjacent panel unit end-to-end.

An object of this invention is to provide a new and improved construction for upright panel units to be joined end-to-end, preferably with fewer parts.

Another object is to provide panel units which may be joined end-to-end without the use of tools.

In accordance with one aspect, the present invention provides a panel construction having a series of upright panel units which abut one another end to end to provide a single line joint therebetween, each of the panel units comprising:

(a) a pair of spaced facing sheet members located symmetrically on either side of a vertical central plane through the panel unit, with at each end of the panel unit (b) an inner bracket member, and (c) an outer bracket member, each sheet member having a facing sheet portion and vertical edge portions at each end, each facing sheet portion disposed in a plane parallel to the central plane, each vertical edge portions including a first end portion perpendicular to the central plane, a second end portion and a third end portion perpendicular to the central plane, the first end portion extending laterally inwardly from the facing sheet toward the central plane to the second end portion which extends away from the end to the third end portion which extends laterally inwardly toward the central plane, the inner bracket member having a U-shaped central portion with a central bight member from which two arm portions extend, the central bight member extending perpendicular to the central plane bridging the central plane with the two arm portions extending towards the end defining a bight cavity open toward the end, the outer bracket member having a U-shaped central portion with a central bight member from which two arm portions extend, the central bight member extending perpendicular to the central plane bridging the central plane with the two arm portions extending parallel the central plane towards the end, the outer bracket member received in the bight cavity of the inner bracket with the second end portion and the third end portions of each sheet member received in the bight cavity of the inner bracket intermediate the inner bracket and outer bracket member, the central bight member of the outer bracket member coupled to the central bight member of the inner bracket member with the third end portions of each sheet member in between the central bight member of the outer bracket member and the central bight member of the inner bracket member to securely join the facing sheet members with the first end portions of the facing sheet members at each end disposed in a common end vertical plane, the arm portions of the outer bracket member extending from the central bight member past the first end portion of each facing sheet members for engagement with arm portions of an outer bracket member of a complementary modular panel units in end to end abutting engaged relation therewith, one arm of each outer bracket member comprising a male arm and the other arm of each outer bracket member comprising a female arm, wherein a female arm of each outer bracket member engages a female arm of each outer bracket member, the male and female arms engageable and disengageable merely by respective movement the one panel units relative the other towards, or away from, each other with their central planes disposed in a common center plane.

BRIEF DESCRIPTION OF THE DRAWINGS

Further aspects and advantages of the present invention will be apparent from the following description taken together with reference to the following drawings in which.

DETAILED DESCRIPTION OF THE DRAWINGS

Figure 1:
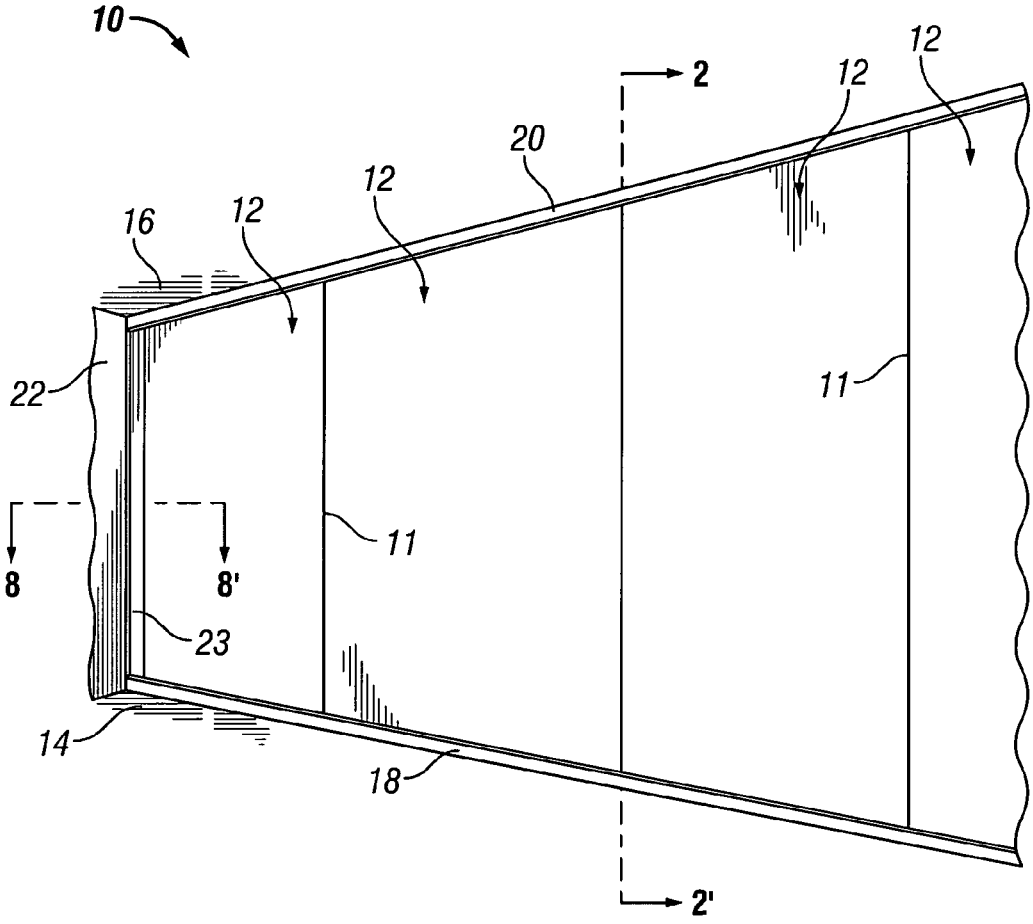
FIG. 1 is a perspective view of a wall showing a number of panel units in accordance with a panel construction of a first embodiment of the present invention.
Figure 2:
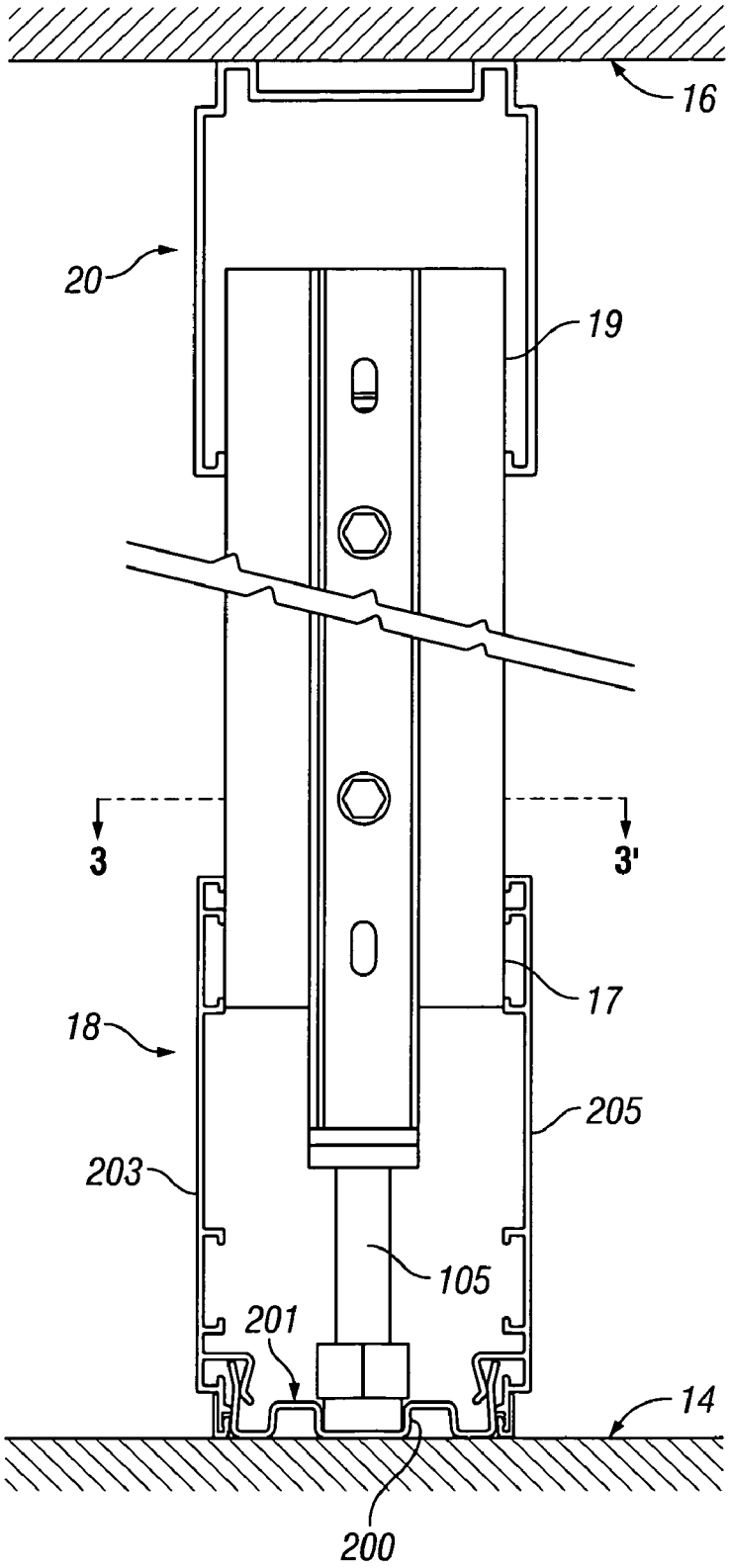
FIG. 2 is a cross-sectional end view such as along section line 2-2' in FIG. 1 showing the floor trackway and overhead trackway in cross-section but showing the end of one panel unit not cross-sectioned.

FIG. 1 is a perspective view of a portion of a wall 10 for a building representing a panel construction formed from a series of upright panel units 12 which abut one another end-to-end. In FIG. 1, portions of four panels 12 are shown. In FIG. 1, the panel units have a height so as to extend between a floor 14 and a ceiling 16. A floor trackway 18 is shown secured to the floor with a lower portion 17 of each panel unit 12 received within the floor trackway 18. At the ceiling 16, an overhead trackway 20 is shown secured to the ceiling and within which the upper portion 19 of each panel unit is received. The interaction of the panel unit 12 with the floor trackway 18 and the ceiling trackway 23 is best seen in FIG. 2. FIG. 1 also shows the wall 10 of panel units 12 ending at a transversely extending wall 22 and with a wall channel member 23 secured to the wall which wall channel member 23 is adapted to receive one end 103 of the adjacent panel unit 12 as best seen in cross-section in FIG. 8.

Figure 3:
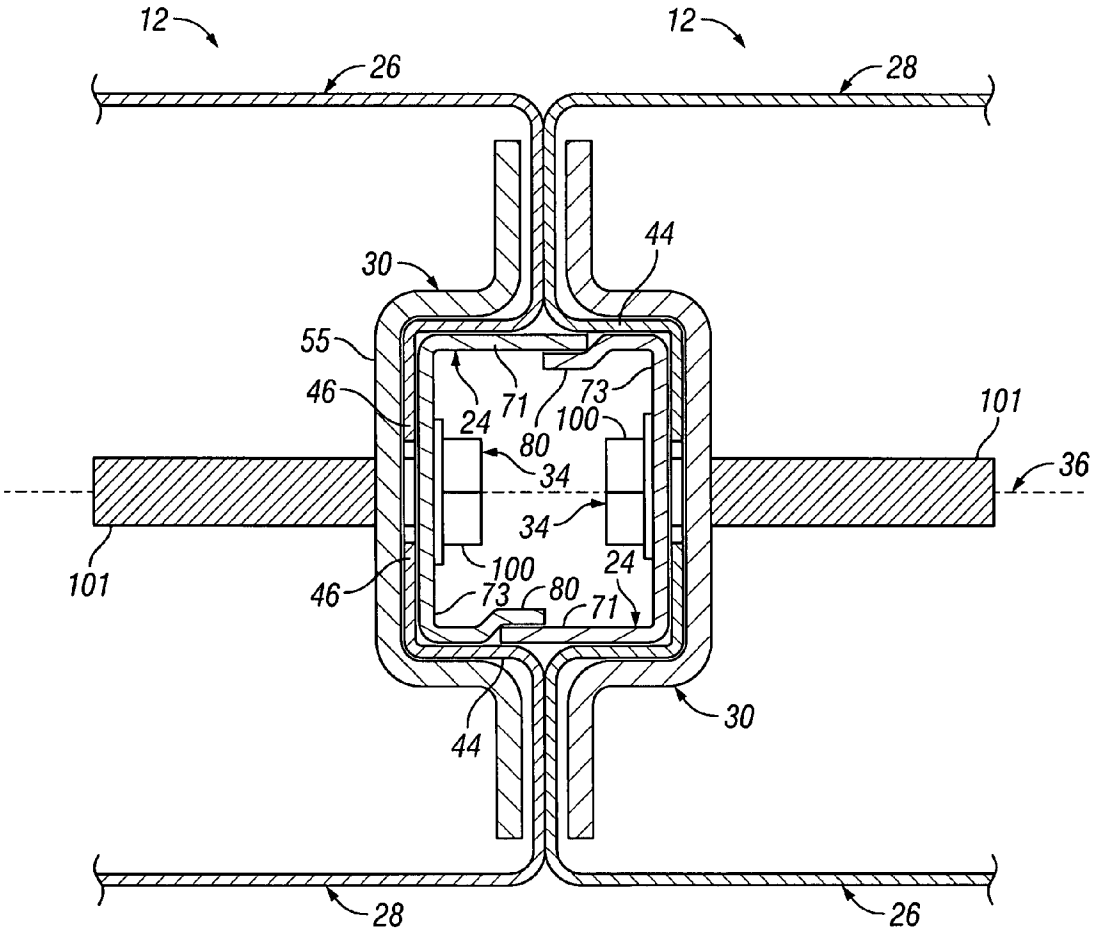
FIG. 3 is a cross-sectional view along section line 3-3' in FIG. 2 but showing the junction between the ends of two coupled panel units.

Reference is made to FIG. 3 which shows a cross-sectional plan view through an end-to-end juncture between two panel units 12 such as along section line 3-3' in FIG. 2.

As seen in FIG. 3, each panel unit 12 comprises at each end an outer bracket member 24, a pair of spaced facing sheet members 26 and 28, an inner bracket member 30 and connection bolts 34 of which only one is shown for each panel unit.

Figure 4:
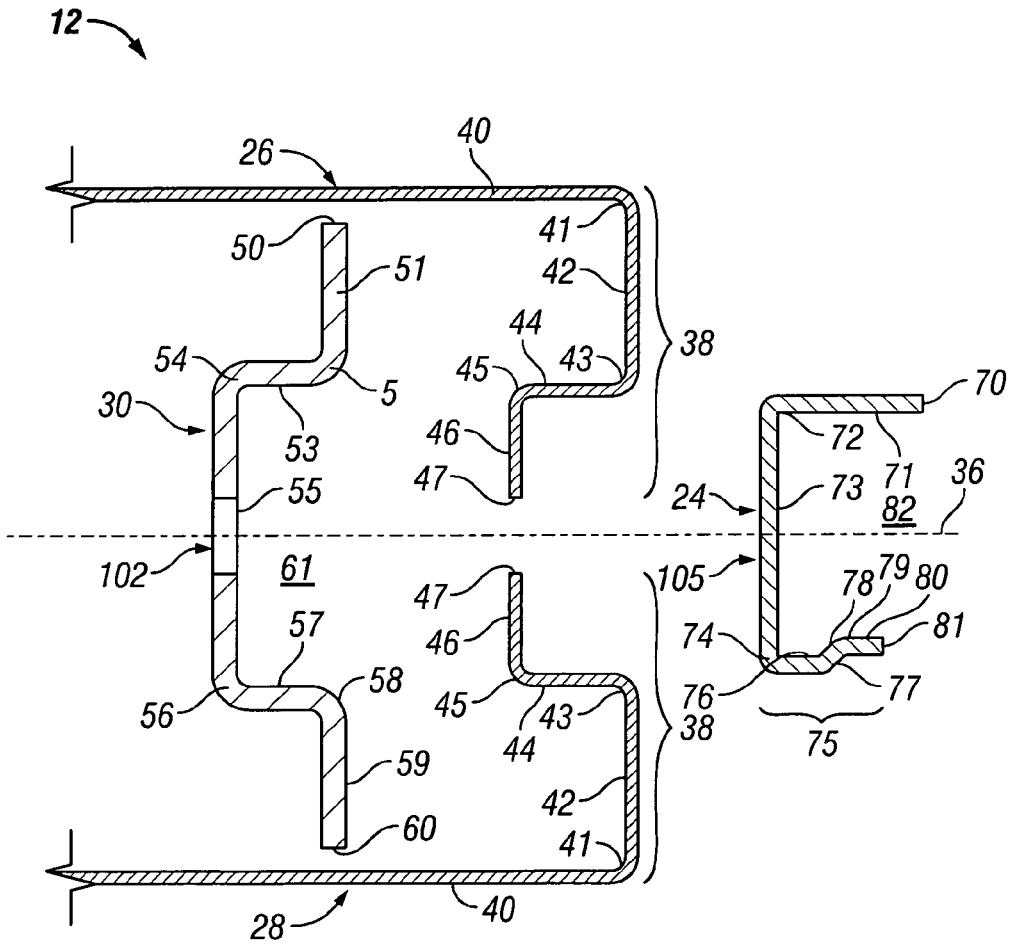
FIG. 4 is an exploded cross-sectional plan view similar to FIG. 3 of one end of a panel unit without the connection bolt.

In FIG. 3, a dashed line 36 represents a vertical central plane through the panel unit 12. The facing sheet members 26 and 28 are a mirror image of each other and are located symmetrically on either side of the central plane 36. As seen in FIG. 4, each sheet member 26 and 28 has a vertical edge portion at each end generally indicated 38 which extend the height of the panel unit 12 at each end and a facing sheet portion 40 which extends between the edge portions 38. Each facing sheet portion 40 is disposed in a plane parallel to the central plane 36 but spaced laterally therefrom. Each vertical edge portion 38 includes a first end portion 42 perpendicular to the central plane, a second end portion 44 parallel to the central plane and a third end portion 46 perpendicular to the central plane. Each facing sheet portion 40 merges at a corner 41 with the first end portion 42 which extends laterally inwardly from the facing sheet 40 towards the central plane 36 to a corner 43 where the first end portion 42 merges with the second end portion 44. The second end portion 44 extends away from the end of the panel unit to a corner 45 where the second end portion 44 merges with the third end portion 46. The third end portion 46 extends laterally inwardly towards the central plane 36 to a laterally inner edge 47.

As seen in FIG. 4, the inner bracket member 30 is shown as having a generally top-hat shape with a U-shaped central portion formed by a central bight member 55 from which two arm portions 53 and 57 extend. The central bight member 55 extends perpendicular to the central plane 36 and bridges the central plane 36. The two arm portions 53 and 57 extend towards the end of the panel unit defining a bight cavity 61 open towards the end of the panel unit. As seen, the central bight member 55 merges at a corner 54 into the arm portion 53 and at a corner 56 into the arm portion 57. The arm portion 53 merges at a corner 52 into a lateral flange portion 51 which extends towards the end of the panel unit and ends at an end 50. In a similar manner, the central bight member 55 merges at a corner 56 into the arm portion 57 which merges at a corner 58 into a lateral flange portion 59 extending towards the end of the panel unit and ending at a lateral edge 60. Each of the lateral flange portions 51 and 59 are disposed to have surfaces 49 and 61 in a common plane perpendicular to the central plane 36.

The outer bracket member 24 has a central bight member 73 from which two arm portions 71 and 75 extend. The central bight member 73 extends perpendicular to the central plane 36 bridging the central plane with the two arm portions 71 and 75 extending towards the end of the panel unit. The central bight member 73 merges at a corner 72 into the arm portion 71 which extends to an end 70. The central bight member 73 merges at a corner 74 into the arm portion 75. The arm portion 75 includes an inner arm segment 76 which merges at a corner 77 into a short offset arm segment 78 extending towards the center line 36. The offset arm segment 78 merges at a corner 79 with the outer arm segment 80 which extends towards the end of the panel unit to end at an end 81. The end 70 of the arm portion 71 lies in the same plane perpendicular to the central plane 36 as the end 81 of the arm portion 75. The outer bracket member 24 defines within its central bight member 73 and its two arm portions 71 and 75 a bight cavity 82 open towards the end of the panel unit.

As seen in FIG. 3, the third end portion 46 and the second end portion 44 of each of the facing sheet members 26 and 24 are received within the bight cavity 61 of the inner bracket member 30 with the third end portions 46 engaging the central bight member 55. The U-shaped central portion of the outer bracket member 24 formed by the central bight member 73 and the arm portions 71 and 75 is also received in the bight cavity 61 of the inner bracket member 30 with the central bight member 73 of the outer bracket member 24 overlying the third end portions 46 of each of the facing sheets 26 and 28 located on respective sides of the central plane 36.

The connecting bolt 34 has an enlarged head 100 from which a threaded shaft 101 extends. The connecting bolt 34 is adapted to extend through an opening 105 in the central bight member 73 of the outer bracket member 24, between the laterally inner ends 47 of the third end portion 46 of each sheet member 26 and 28 into a threaded opening 102 in the central bight member 55 of the inner bracket member 30. The compression bolt 34 applies forces so as to clamp the outer bracket member 24 onto the inner bracket member 30 fixedly clamping third end portions 46 of the sheet members 26 and 24 therebetween against movement. The head 100 of the connecting bolt is accessible through the bight cavity 61 of the outer bracket member 24 when the end of the panel unit 12 is not coupled end-to-end to another panel unit.

Figure 5:
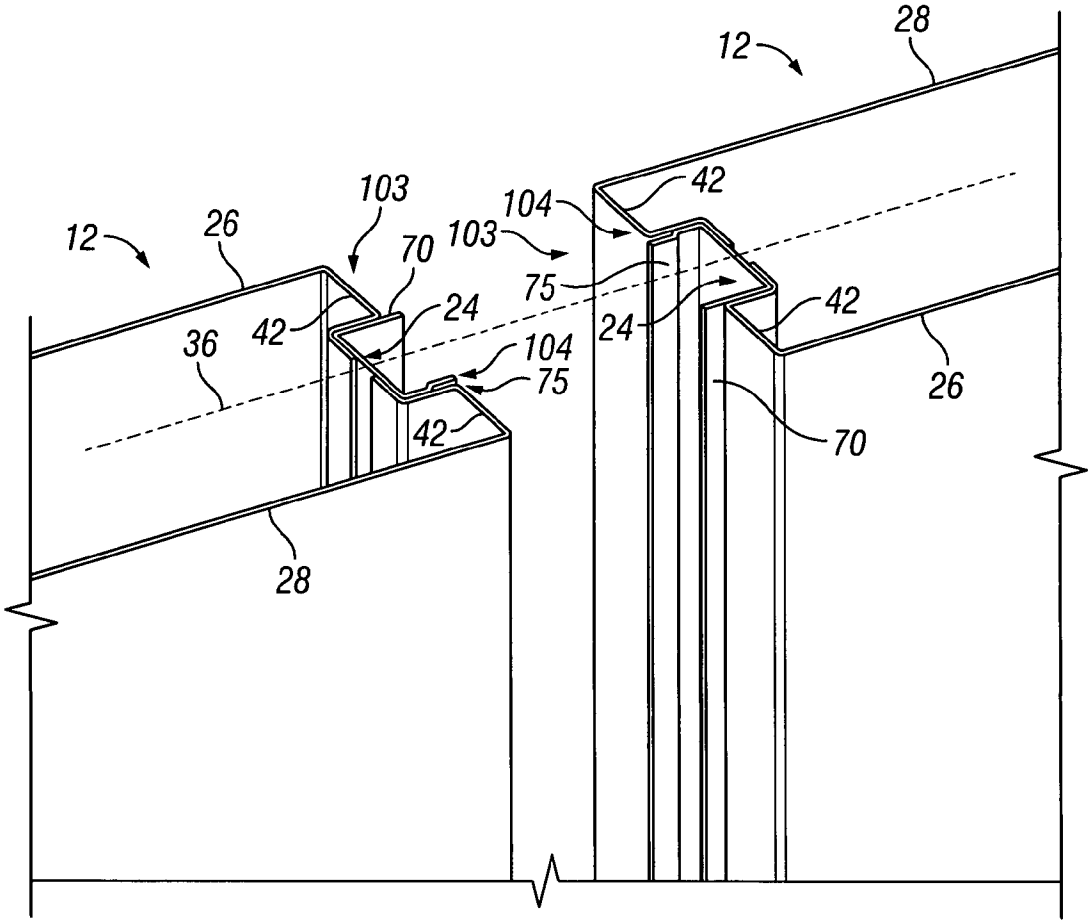
FIG. 5 is a schematic pictorial view showing as selected portions of the panel units of the first embodiment, two sheet members and an outer bracket member, with the ends of the panel units axially aligned but spaced from each other.

As seen in FIGS. 3 and 4, the inner bracket member 30 is symmetrical about the center plane 36. The outer bracket member 24 and notably its arm portions 71 and 75 are not symmetrical but rather may be considered to be left or right handed with the arm portion 71 extending straight from the corner 72 and the arm portion 75 extending in an offset configuration. The arm portion 75 is offset by the width of the arm portion 71 such that as can be seen in FIG. 3, the arm portion 71 of one panel unit 12 is to be engaged in a slotway 104 between the second end portion 44 and the outer arm segment 80 of the arm portion 75 of the other panel unit in a male/female type relationship. As seen in FIG. 5 at the end of each panel unit 12, between an outside surface of the outer arm segment 80 of the arm portion 75 of the outer bracket member 24 and an inwardly directed surface of the second end portion 44 of the sheet member, this slotway 104 is provided sized to closely receive in a frictional arrangement the arm portion 71 of another panel unit preferably in a relatively snug fit.

FIG. 5 is a schematic pictorial view of the panel units 12, however, showing only the sheet members 26 and 28 and the outer bracket members 24 for ease of illustration. In FIG. 5, the end 103 of one panel unit 12 is orientated in line with the end 103 of the other panel unit 12 such that each panel unit is disposed albeit with their ends spaced apart, however, with their common central planes 36 coincident. From this position, the panel units 12 can be slid together with the result that the arm portions 71 of the outer bracket member 24 on each panel unit will engage with the arm portion 75 of the outer bracket 24 on the other panel unit. When pushed together to a closed position as seen in FIG. 3, the first end portions 42 of each of the facing sheet members 26 and 28 on each panel unit 12 engage with the first end portions 42 on the other panel unit forming, as seen in FIG. 1, such a single line juncture 11 at the laterally outer extent of these first end portions 42.

Figure 6:
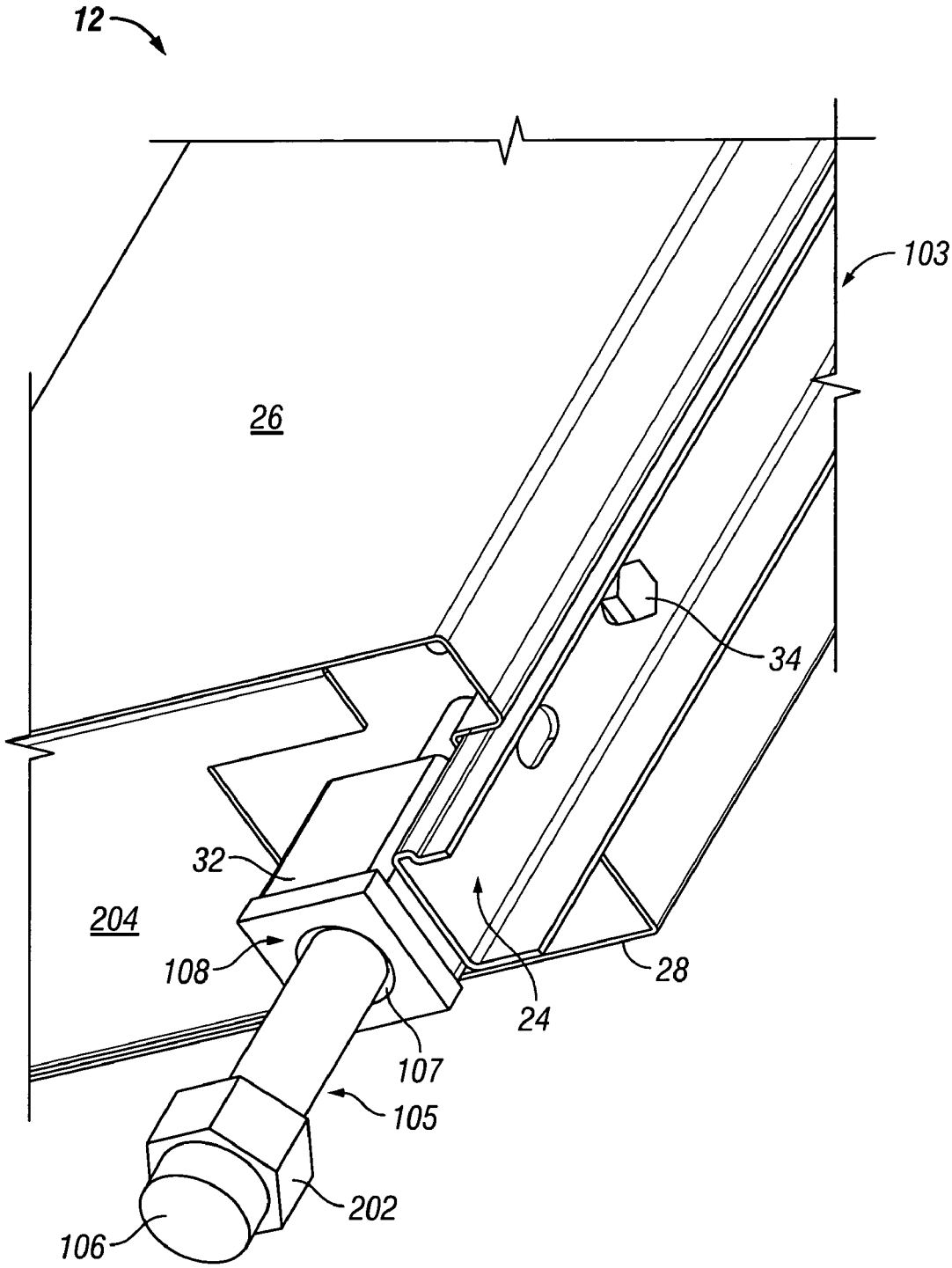
FIG. 6 is a schematic pictorial view of a bottom of one end of a panel unit in accordance with the first embodiment of FIG. 1.
Figure 7:
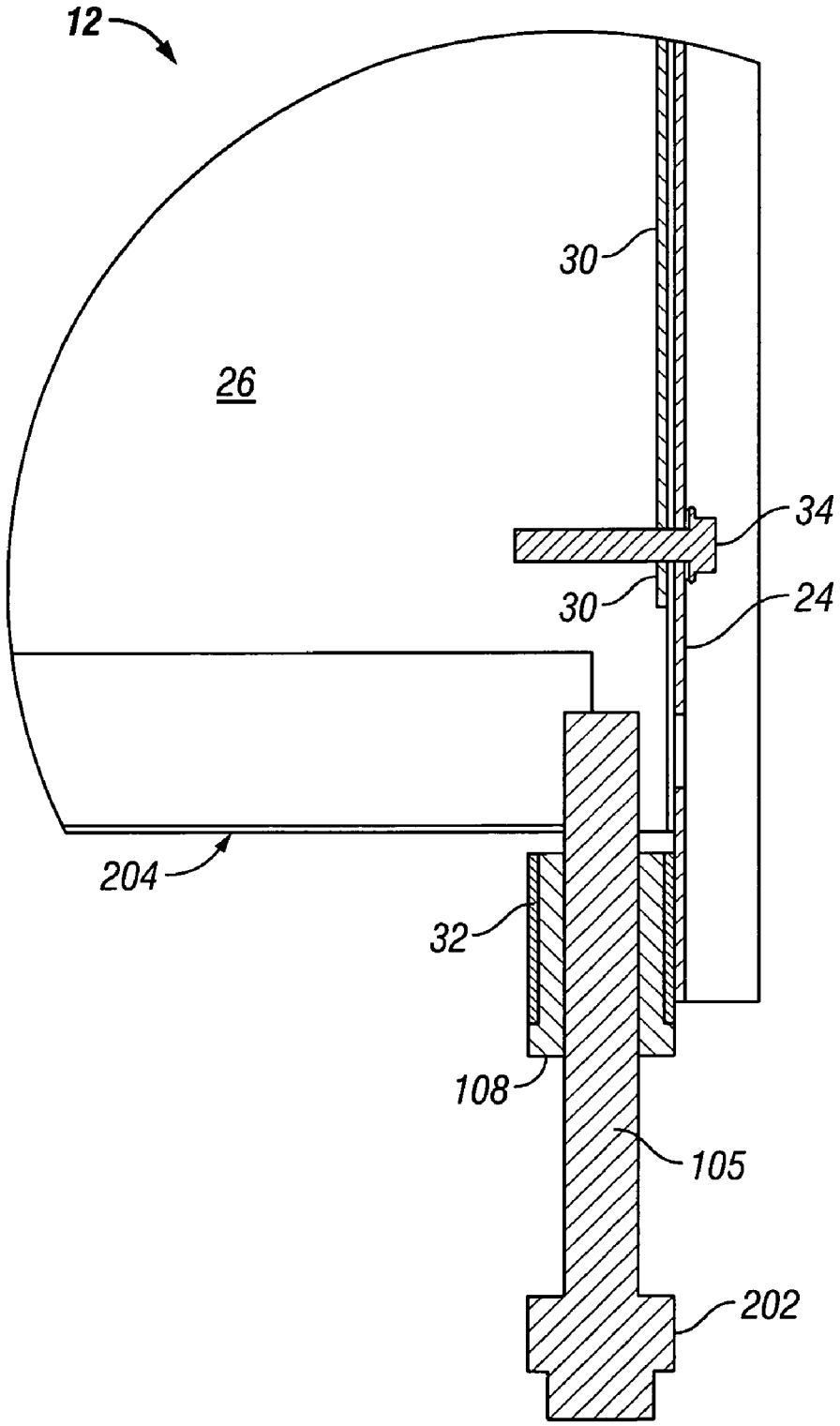
FIG. 7 is a vertical cross-sectional view through the bottom of one end of the panel units shown in FIG. 6.

Reference is made to FIG. 6 which shows an enlarged bottom view of one end 103 of a panel unit 12 of FIGS. 1 and 2 showing a height locating leg 105 which extends downwardly to a foot 106 to slidably engage in a central channelway 200 in a base member 201 of the floor trackway 18. As seen in FIG. 6 as well as FIGS. 2 and 7, the leg 105 is threaded and is received in a threaded opening 107 in a plastic plug 108 fixedly secured within a tubular stop post member 32 which is welded on one side to the central bight member 73 of the outer bracket member 24. In a known manner, rotation of the leg 105 by a hexagonal nut portion 202 permits height adjustment of the end 103 of a panel unit 12. As seen in FIG. 2, the floor trackway 18 comprises the base member 201 and a pair of removable baseboard trim members 203 and 205 which removabl clip onto the base member 201 after the pair of units 12 have been engaged on the base member 201. FIGS. 6 and 7 also show a bottom channel member 204 which is U-shaped and spans between the facing sheet members 26 and 28 along a bottom edge of each. While not shown, a similar top channel member bridges the facing sheet members 26 and 28 along a top edge of each.

In use of the panel units 12 as illustrated in FIGS. 1 to 8, a first panel unit is preferably located in a position it is desired to assume and then a second panel unit may then be aligned end-to-end spaced therefrom as in FIG. 5 and pushed into a position of latched engagement as shown in FIG. 3. The overall weight of each panel unit is typically sufficient to prevent either the panel units from moving end-to-end. The panel units may thus be joined in the latched position end-to-end merely by being located in alignment and without the need for any tools or other coupling devices.

Reference is made to FIGS. 9 to 12 which show a second embodiment of a panel unit in accordance with the present invention. The second embodiment is substantially identical to the first embodiment with the following exception.

Figure 9:
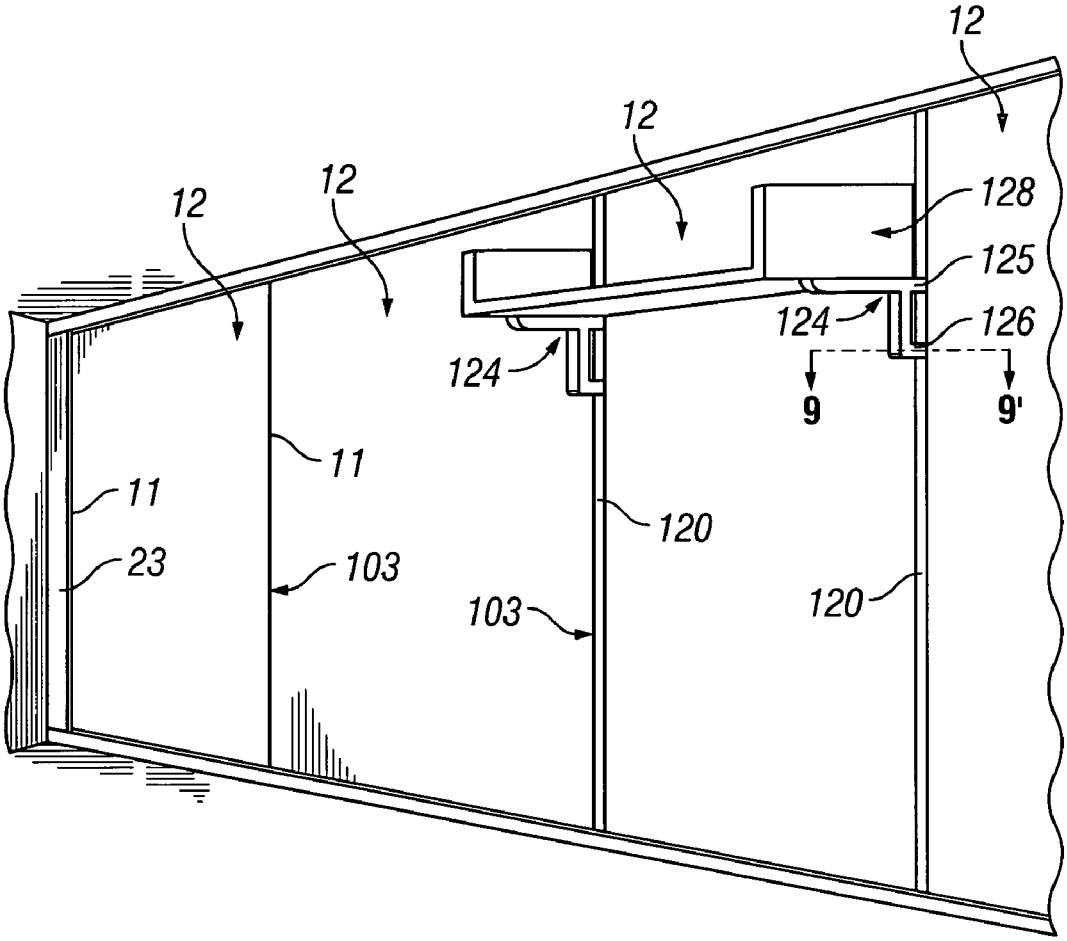
FIG. 9 is a perspective view of a wall showing a number of panel units in accordance with a panel construction of a second embodiment of the present invention.
Figure 10:
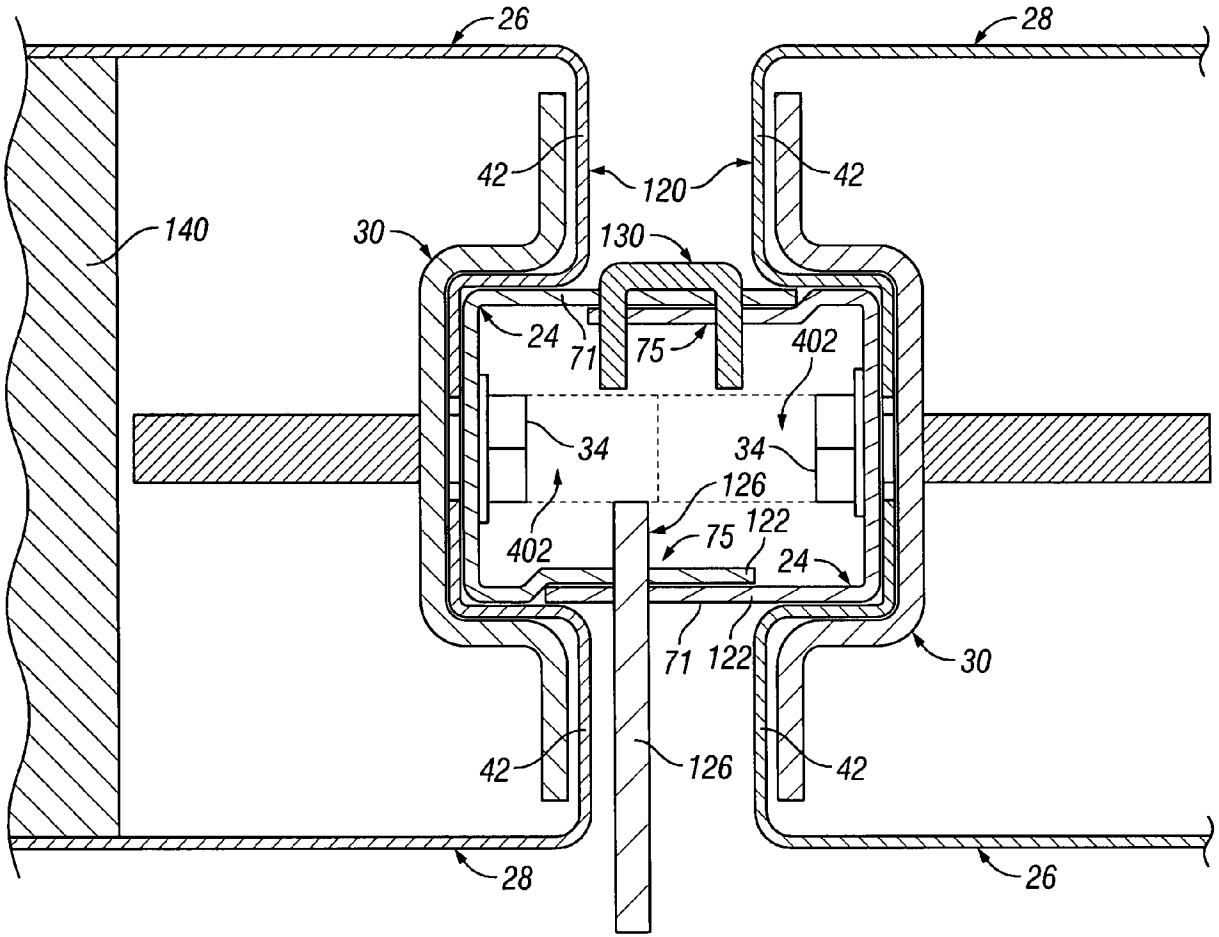
FIG. 10 is a cross-sectional plan view along section line 9-9' in FIG. 9.
Figure 11:
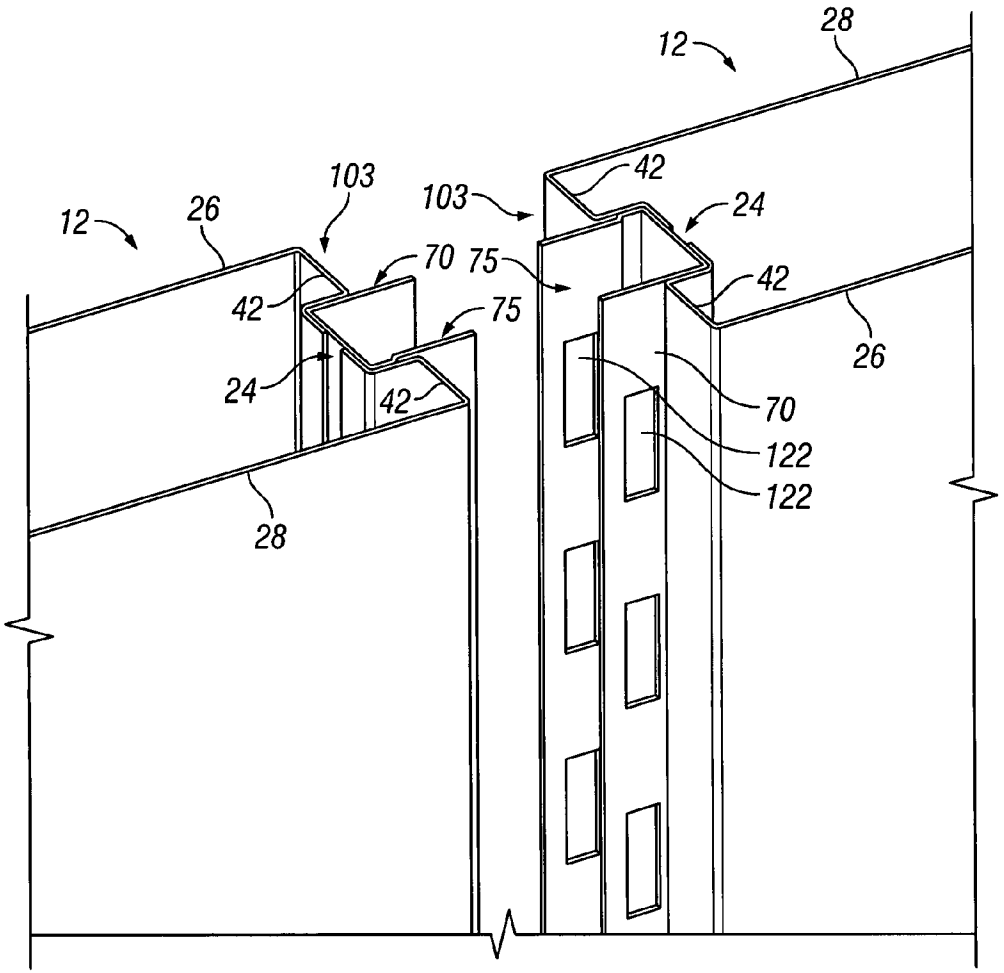
FIG. 11 is a schematic pictorial view showing as selected portions of panel units of the second embodiment, two sheet members and an outer bracket member, with the ends of the panel axially aligned but spaced from each other.
Figure 12:
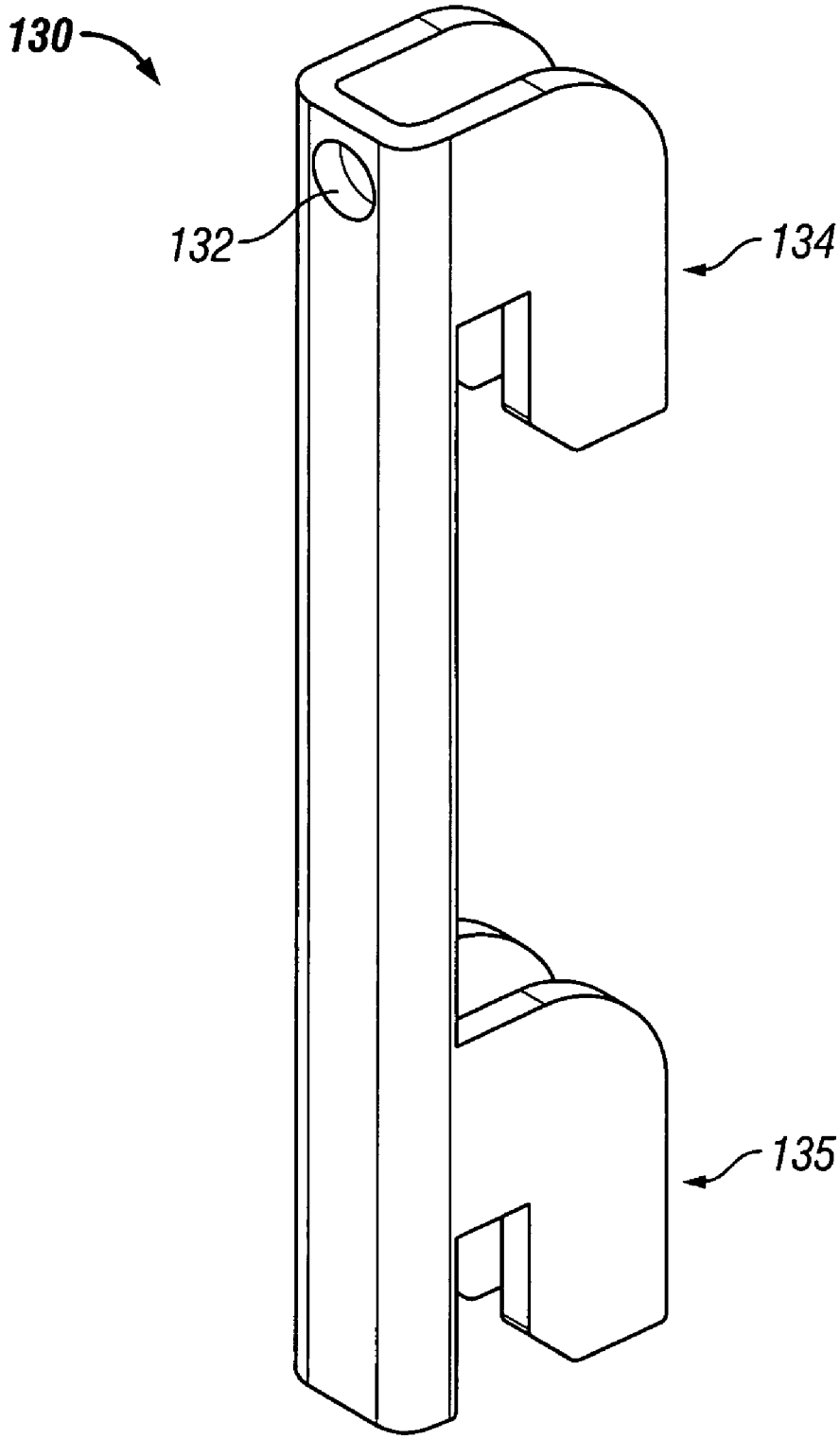
FIG. 12 is a perspective view of a link clip for use with the panel unit of the second embodiment shown in FIGS. 9 to 11.

As a first exception, in the second embodiment, each outer bracket member 24 has arm portions 71 and 75 which are of an increased length such that when they become engaged and the panel units 12 are in the latched position of FIG. 10, a gap 120 of predetermined width is provided between the first end portions 42 of the facing sheet members 26 and 28. As a second exception, each of the arm portions 71 and 75 of the outer bracket member 24 are provided with rectangular openings 122 therethrough which openings come to be in alignment as shown in the latched position of FIG. 10 with an opening 122 in the arm portion 71 of one panel unit aligning with an opening 122 in an arm portion 75 of the other panel unit. FIG. 10 represents a horizontal cross-section through such openings 122. These openings 122 are provided to accommodate one or more furniture coupling or support brackets 124 of a known type such as schematically shown in FIG. 9. The support brackets 124 have two hook arms 125 and 126 which engage within the openings 122 such that the brackets 124 are supported extending outwardly preferably perpendicular to the central plane 36 as to support various furniture components such as shelving units 128 shown in FIG. 9 although other items such as desk tops, overhead cabinets and the like may also be supported or connected as is known in the art. If desired, as seen in FIGS. 10 and 11, an optional link clip 130 may be inserted into the aligned openings 122 so as to secure the abutting ends of the panel units together against separation and with the openings 122 suitably aligned. The link clip 130 carries two pairs of hook arms 134 and 135 which engage within the openings 122. As seen in FIG. 10, the link clip 130 does not extend outwardly in the gap 120 beyond the facing sheet members 26 and 28. One or two such link clips 130 may optionally be provided in gap 120 on each side of a juncture between two abutting panel units albeit in openings 122 which are not to receive hook arms of support brackets 124. The link clip 130 includes an opening 132 to assist in removal of the link clip 130.

Optionally, as shown in dashed lines in FIG. 10, light and sound seal members 402 may be provided between the ends 103 of the panel units 12 as to assist in light and/or sound passing through the junction between the panel units. These seal members 402 may be an elongate member of resilient foamed plastic.

The preferred embodiments show the use of the threaded bolts 34, however, rivets and other fasteners could replace the bolts 34. Also, rather than have connecting members in the form of separate fasteners such as the bolts 34 or rivets, the sandwich construction of the inner bracket member 40, the third end portion 46 of each facing sheet member 26 and 24 and the outer bracket member 24 could be welded together as a unit.

The construction illustrated in both preferred embodiments provides a relatively rigid arrangement for securing the ends of the sheet members 26 and 28 together and one which advantageously permits these sheet members to be located without the necessity for a central core. However, a central core preferably is provided between the facing sheet portions of each sheet member as, for example, in the form of a full or partial core of foam material shown schematically as 140 on FIG. 10 as can be desirable for sound insulating purposes as while as serving to increase the structural integrity of the resultant panel unit.

In the preferred embodiment, the inner bracket member 30 is shown as having its two arm portions 53 and 57 which extend parallel to the central plane 36 and the second end portion 44 of each of the facing sheet members 26 and 28 is shown as extending parallel to the central plane 36. This is not necessary and these portions could be provided disposed at some angle to the central plane preferably tapering laterally outwardly as they extend towards the end of the panel.

With both preferred embodiments, each of the panel units 12 is preferably an identical construction to the other panel units 12 and, in that sense, they may be considered modular and replaceable.

The panel construction has the advantage that each of the two facing sheet members 26 and 28 may be identical. While an inner bracket member 30 is provided at each end of the panel unit 12, each of the inner bracket members 30 are identical. Similarly, at each end of each panel unit 12, there is provided an outer bracket member 24. Each of the outer bracket members 24 may be identical. It is to be appreciated, the outer bracket members 24 are to be disposed such that a person on facing the one end of a panel unit 12 will always see the same arm portion on the same lateral side such that when the modular panel units are arranged end-to-end, there is proper male to female nesting of the arm portions 71 of each panel unit with the complementary arm portion 75 of the other panel unit.

The invention discloses two different embodiments, the first embodiment shown in FIG. 10 in which there is no gap between the first end portions and the embodiment of FIG. 2 in which there is the gap 120. However, it is particularly advantageous that as between the two embodiments, the only difference in the panel units 12 are the particular outer bracket member 24 and, more particularly, the relative length of the arm portions of the outer bracket member 24. Thus, any panel unit 12 may be configured as may be desired have as its outer bracket member 24 one or both of the outer bracket member 24 of the first embodiment and the outer bracket member 24 of the second embodiment. A panel unit 12 may, for example, have the outer bracket member 24 of the first embodiment at one end and, at the other end, have the outer bracket member 24 of the second embodiment. Such a panel unit is shown in FIG. 9 as the panel unit 12 to the left of the panel unit which the shelving unit 128 bridges, with such panel unit 12 having a gap 120 on its right end 103 and a single line juncture 11 on its left end 103. Further, with the outer bracket members 24 being coupled by the removable threaded bolts 34, it is possible for persons on site to selectively remove or apply any particular outer bracket member 24 as may be desired for any particular configuration of walls as, for example, in a wall which may be formed of panel units 12 of the first embodiment to be modified so as to have one or both outer bracket members 24 replaced with outer bracket members 24 of the second embodiment as to permit brackets 124 to support furniture or other elements to be hung therefrom.

Figure 13:
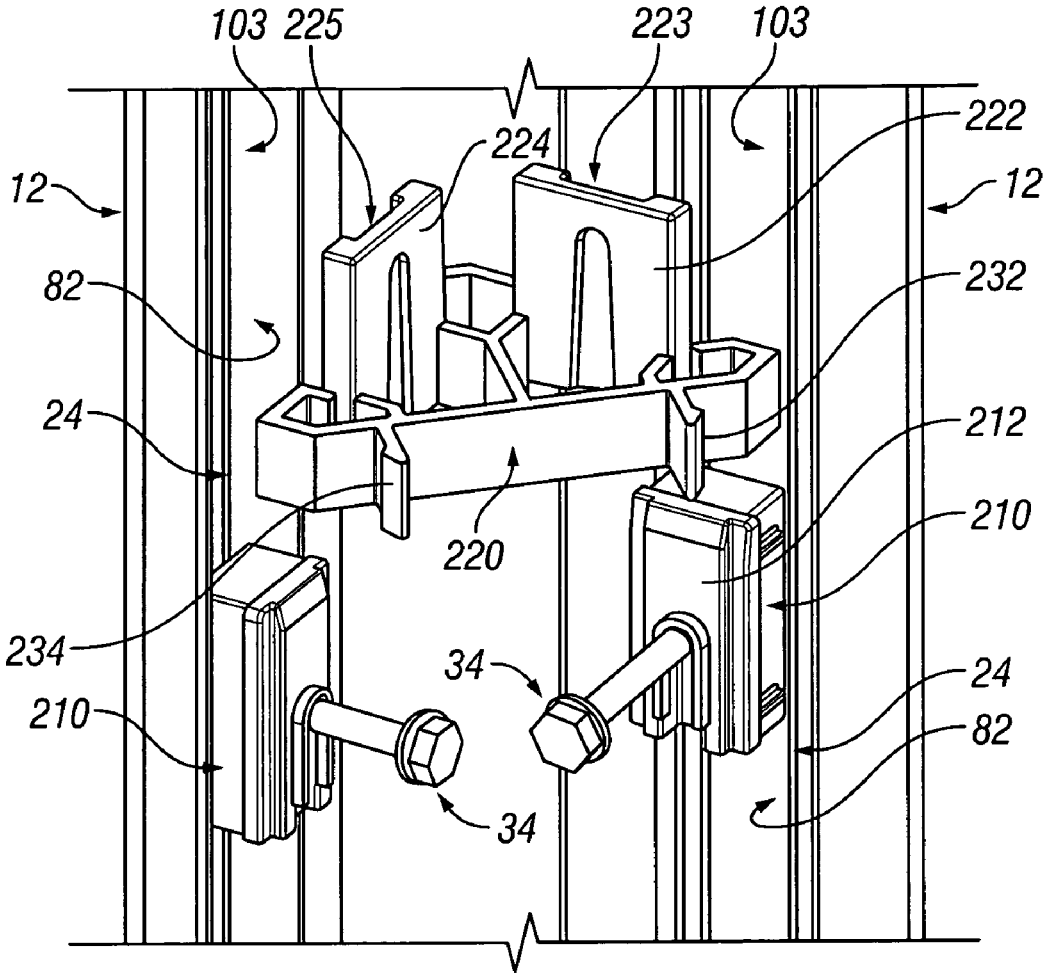
FIG. 13 is a schematic pictorial view partially showing the ends of two panel units ready for joining together at 90 degrees to each other.
Figure 14:
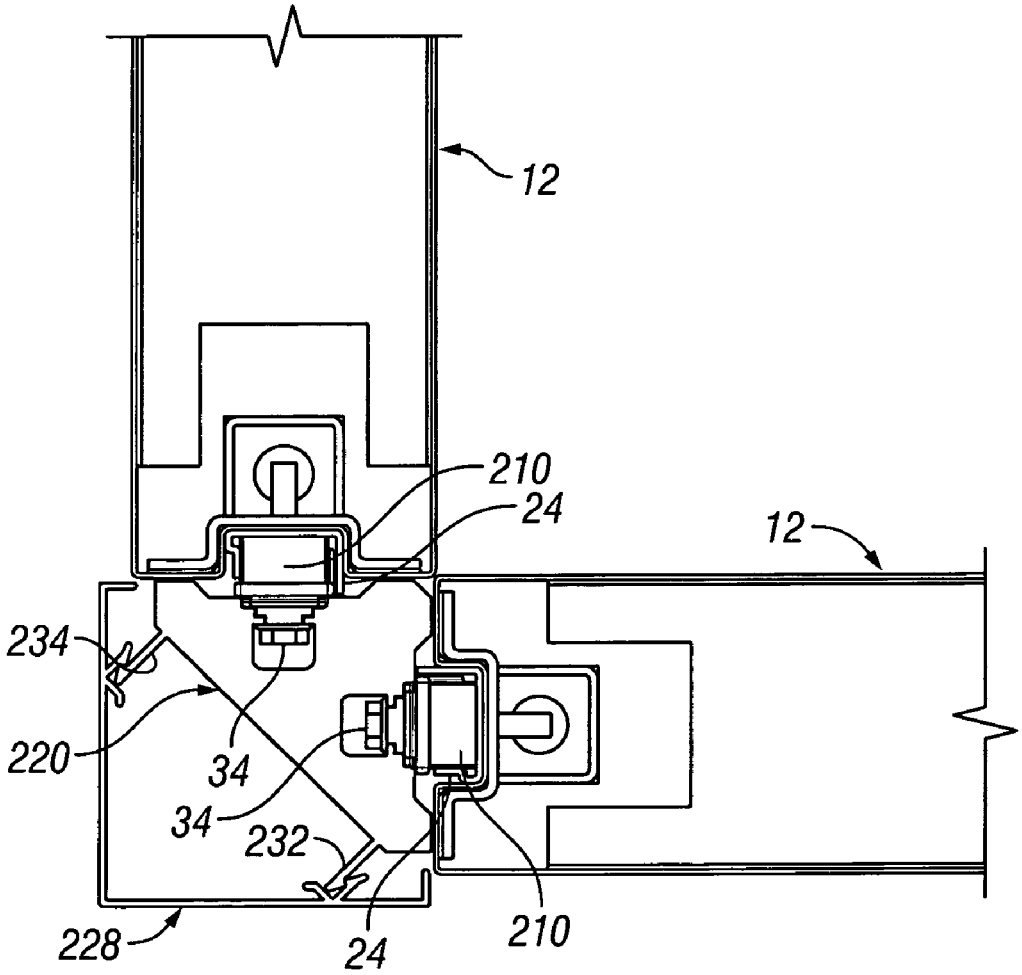
FIG. 14 is a horizontal cross-sectional view through two panel units joined together at 90 degrees in a similar arrangement to that shown in FIG. 13.

Reference is made to FIGS. 13 and 14 which show an arrangement for coupling the ends 103 of two panel units 12 together at right angles to each other. FIG. 13 is a pictorial view which schematically illustrates the ends 103 of two panel units 12 disposed proximate to each other and with each of the panel units 12 extending at 90 degrees to the other. In FIG. 13, one bolt 34 from each panel unit 12 is shown as in a loose and extended position with a coupling block 210 engaged on each bolt with an inner end of each coupling block 210 engaged within the bight cavity 82 of the outer bracket member 24. As best seen in cross-sectional plan view of FIG. 14, each of the bolts 34 are tightened so as to secure the block member 210 within the bight cavity 82 of the outer bracket member 24. Each block member 210 carries a vertically extending dovetail member 212 with undercuts at each side. A bracket member 220 is best shown in perspective view in FIG. 13 as having two slide plates 222 and 224 disposed at a right angle to each other and each having a dovetail channel 223 and 225 adapted to slide vertically over the dovetail member 212 of each of the block members 210 so as to fixedly secure each of the block members 210 and thus ends 103 of each of the panel members 12 together in a desired 90 degree orientation. As best seen in top view in FIG. 14, a trim member 228 is provided adapted to snap-fit onto a pair of prong members 232 and 234 carried on the bracket member 220. Thus, it is to be appreciated that preferably at least two such bracket members 220 are secured to the ends of the panel units 12 at vertically spaced locations and a suitable vertically extending trim member 228 can then be clipped to the bracket member so as to provide a decorative right angled end trim.

FIGS. 15 to 19 illustrate different usages of the block member 210 as shown in FIGS. 13 and 14 for coupling the ends of panel units in various configurations.

Figure 15:
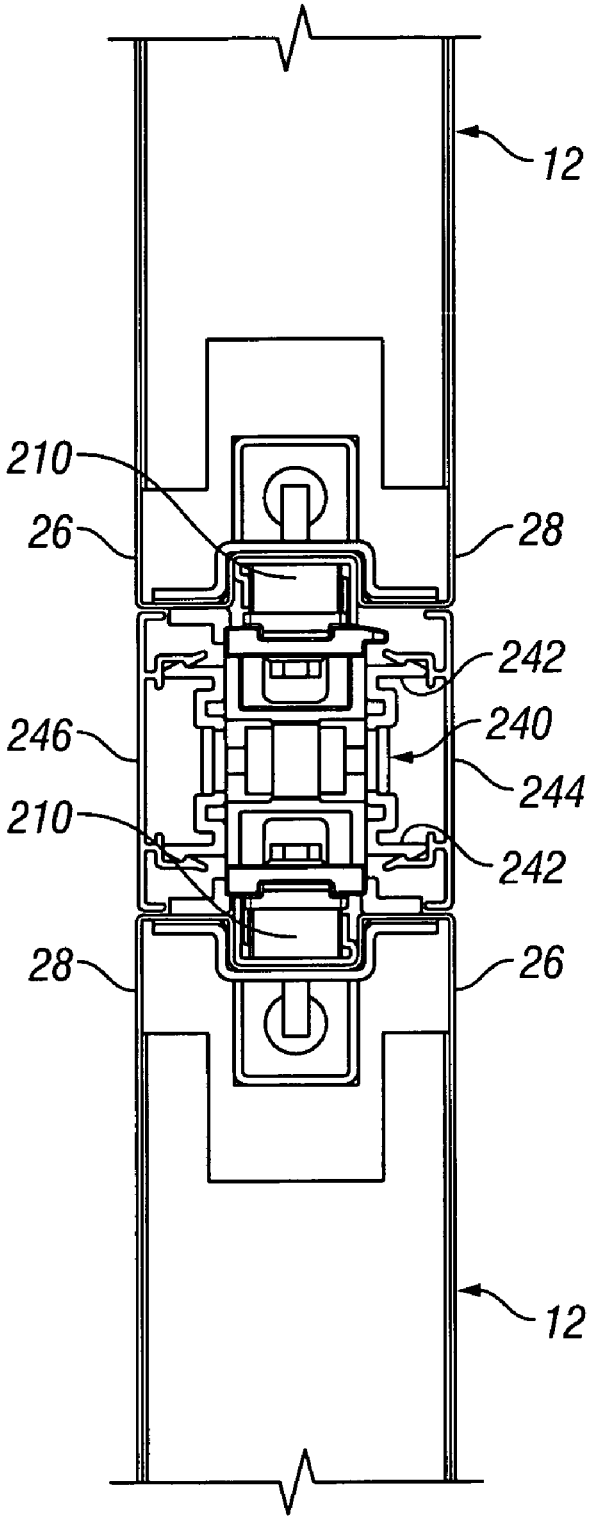
FIG. 15 is a horizontal cross-sectional view through a juncture joining two panel units end-to-end.

FIG. 15 illustrates an arrangement in which the block members 210 are applied to the ends of panel units 12 disposed in line with each other. Coupled to the dovetail member of each block unit 210 is an inline bracket member 240 adapted to engage the block members 210 of the spaced ends of the panel units 12 as shown. The inline bracket member 240 includes on each side pairs of prong members 242 to which vertical trim members 244 and 246 may be provided preferably flush with the side surfaces of the facing sheet member 26 and 28.

Figure 16:
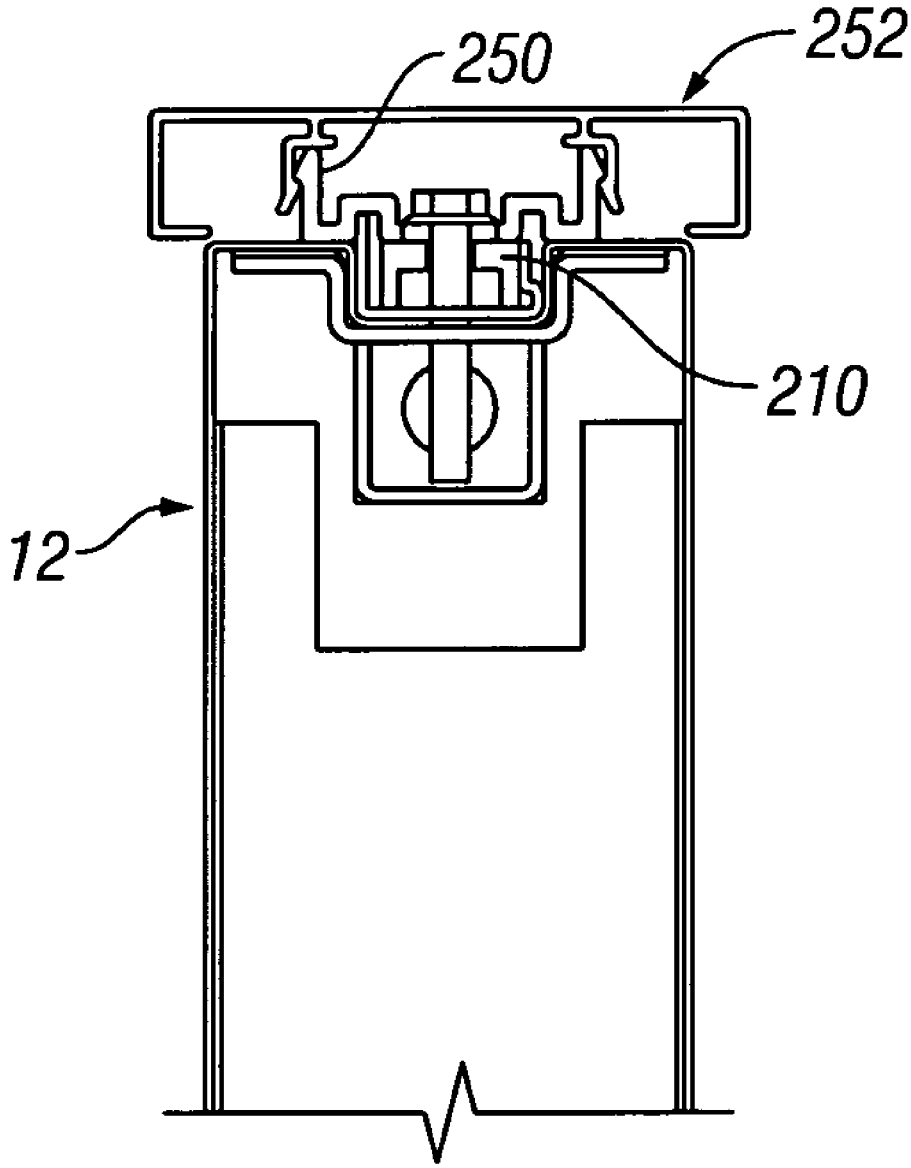
FIG. 16 is a horizontal cross-sectional view showing one end of a panel unit with an end cap.

FIG. 16 illustrates an arrangement in which a block member 210 may be coupled to the end of one panel unit 12 with the block member 210 having prong members 250 to removably receive an end trim member 252 as to decoratively cover one end of the panel unit 12.

Figure 17:
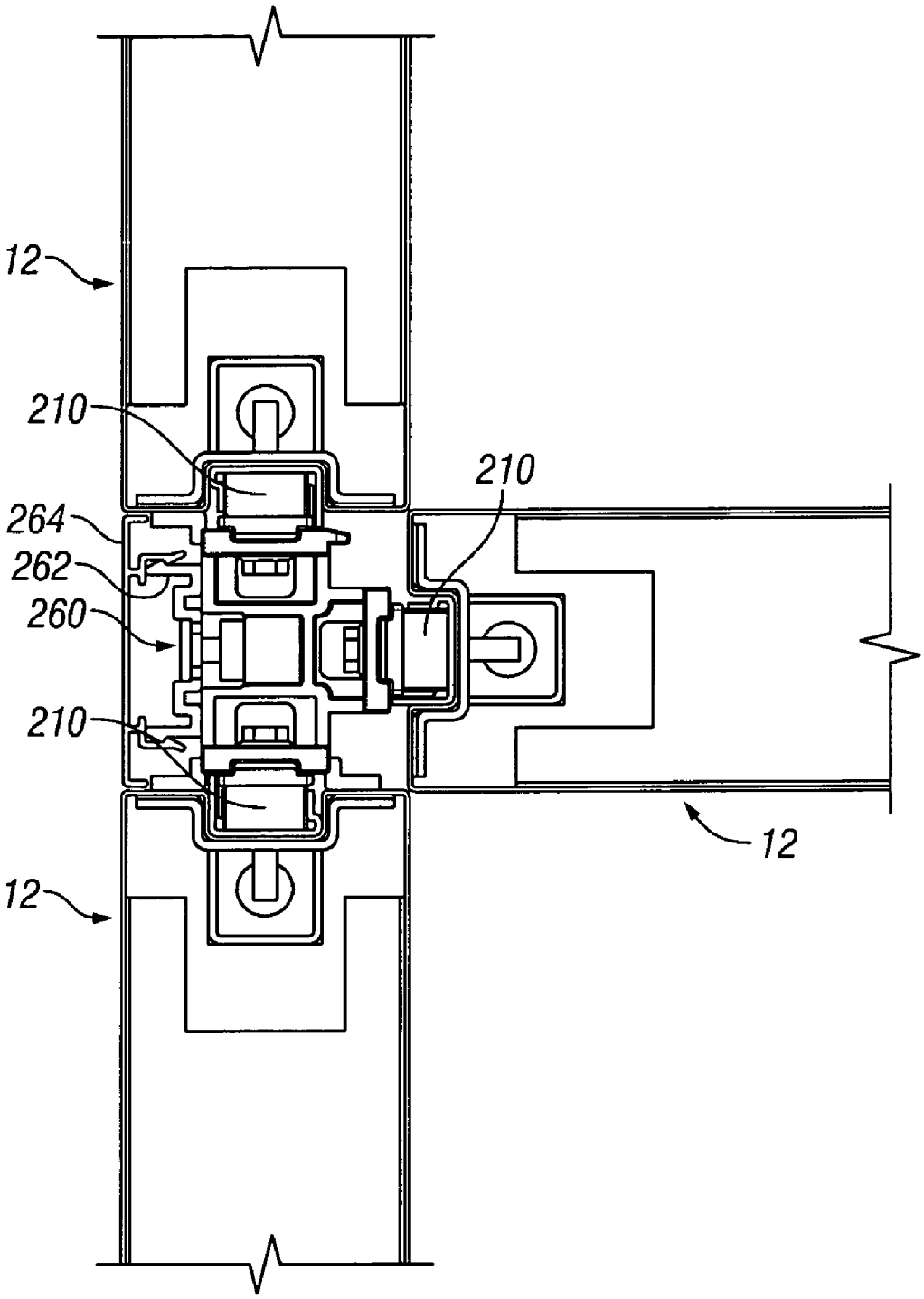
FIG. 17 is a horizontal cross-sectional view showing the ends of three panel units joined together in a three-way T configuration.

FIG. 17 illustrates an arrangement with three panel units 12 disposed at 90 degrees to each other in a three-way connection, with a block member 210 secured to the end of each panel unit and with a three-way connection bracket 260 provided to secure and locate each of the counter units 12 at 90 degrees to each other. The three-way bracket member 260 carries prong members 262 to which a decorative trim member 264 is provided as to close off the open end of the three-way connector.

Figure 18:
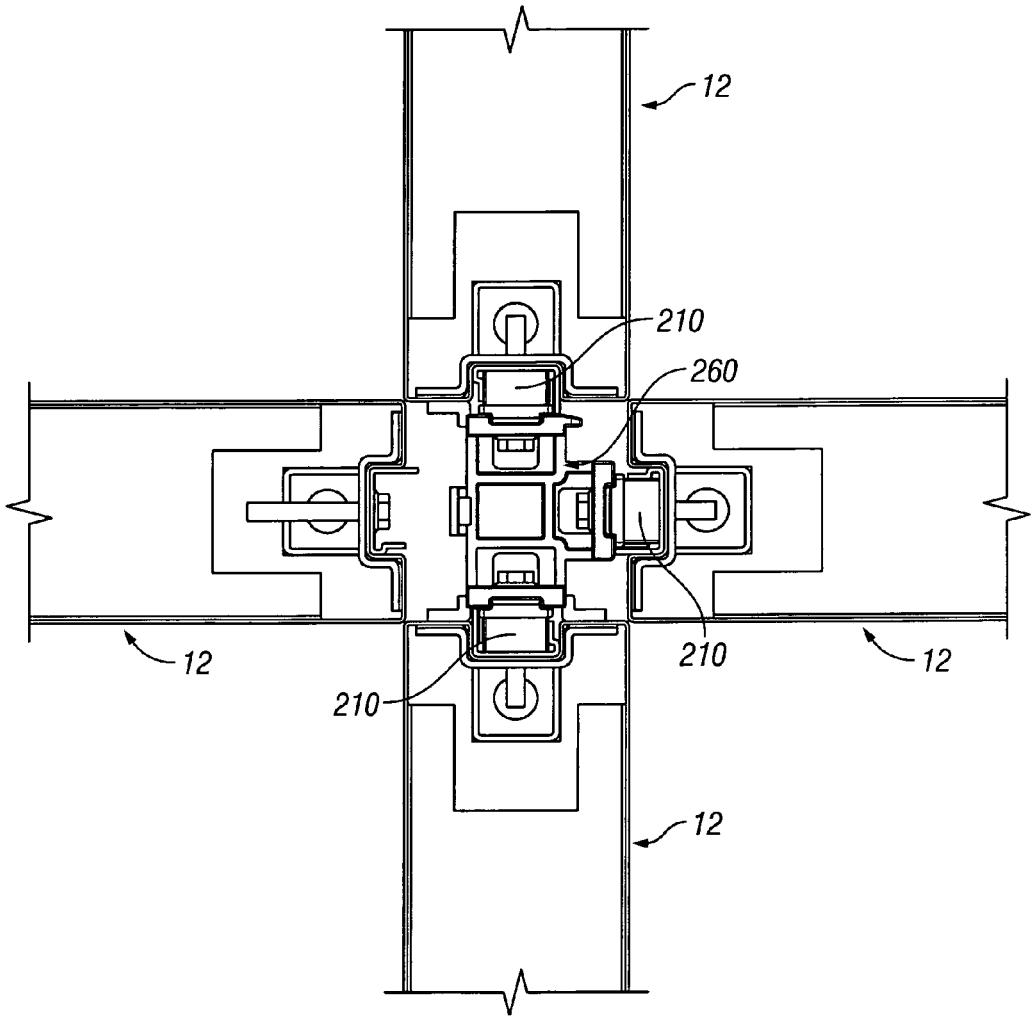
FIG. 18 is a horizontal cross-sectional view showing four panel units joined together in a four-way arrangement.

Reference is made to FIG. 18 which illustrates an arrangement similar to that in FIG. 17 with the three-way connection bracket 260 connecting the ends of three panel units 12 at 90 degrees to each other using the block members 210 and with a fourth panel unit 12 merely located unconnected to the other three panel units 12 but extending as in a four-way connection.

Figure 8:
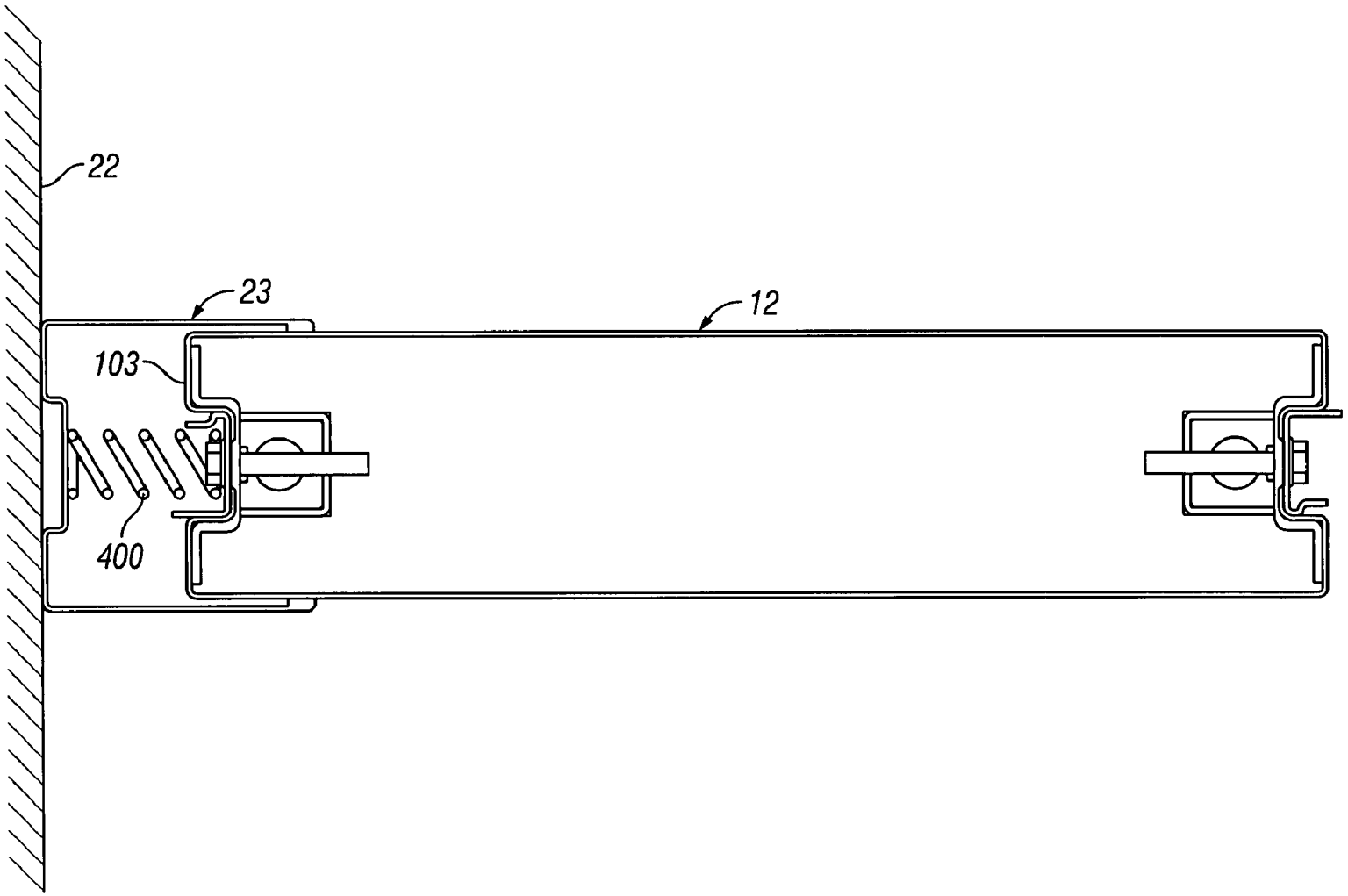
FIG. 8 is a horizontal cross-sectional view along section line 8-8' in FIG. 1 schematically showing one panel unit coupled to a building wall via a wall channel.

Panel members in accordance with the present invention are preferably coupled together end to end as shown, for example, to assume coupled orientations as in FIGS. 3 and 10. Such connections require end-to-end sliding of the panel units 12 for connection and disconnection. In order to accommodate removal of any one panel in the completed wall assembly, it is necessary to provide an ability for the ends of a panel unit 12 to be removed to be displaced laterally a small distance from the ends of each adjacent panel unit. The wall channel member 23 shown in FIG. 8 is preferably utilized with the end 103 of the panel unit 12 received therein spaced from the wall 22 sufficiently that the panel unit 12 engaging the wall channel 23 may be moved towards the wall 22 a sufficient distance to permit, for example, a panel unit 12 adjacent to the wall panel 12 engaged within the wall to be removed from engagement with the panel units at each of its ends. As shown in FIG. 8, a spring member 400 may be provided inside the wall channel member 23 to bias the wall panel 12 outwardly to a desired position and which the spring can be compressed by movement of the panel unit 12 towards the wall 22 to provide adequate space as for removal of other panel units 12 in line with the panel unit 12 adjacent the wall 22.

The coupling arrangement illustrated in FIGS. 13 and 14 also serves a mechanism to permit either one of the panel units 12 coupled at the bracket member 220 to be moved sufficiently to permit that panel unit or panel units in line with the panel unit to be moved to be removed. For example, in FIG. 14, the decorative trim 228 can be removed, the bracket member 220 removed and either of the panel units 12 then slid longitudinally. A similar arrangement arises in respect of the coupling arrangement in FIG. 15 in which by removal of the trim 244 and 246 and the bracket member 240, each of the panel units 12 may then be moved longitudinally an amount sufficient for their removal or for removal of other panel units in line with these panel units.

It is to be appreciated that the same opportunity for movement of each panel unit arises in respect of the arrangements of FIGS. 17 and 18 such that with removal of the connector bracket 260 that one or more of the panel units may be slid longitudinally to permit removal of other of the panel units.

While the invention has been described with reference to preferred embodiments, many modifications and variations will now occur to a person skilled in the art. For a definition of the invention, reference is made to the following claims.

The invention claimed is:

1. A panel construction having a series of upright panel units which abut one another end to end to provide a single line joint therebetween, each of the panel units comprising a pair of spaced facing sheet members located symmetrically on either side of a vertical central plane through the panel unit, with at each end of the panel unit each of an inner bracket member and an outer bracket member, each facing sheet member having a facing sheet portion and vertical edge portions at each end of the panel unit, each facing sheet portion disposed in a plane parallel to the central plane, each vertical edge portions including a first end portion perpendicular to the central plane, a second end portion and a third end portion perpendicular to the central plane, the first end portion extending laterally inwardly from the facing sheet portion toward the central plane to the second end portion which extends away from the end of the panel unit to the third end portion which extends laterally inwardly toward the central plane, the inner bracket member having a U-shaped central portion with a central bight member from which two arm portions extend, the central bight member of the inner bracket member extending perpendicular to the central plane bridging the central plane with the two arm portions of the inner bracket member extending towards the end of the panel unit defining a bight cavity open toward the end of the panel unit, the outer bracket member having a U-shaped central portion with a central bight member from which two arm portions extend, the central bight member of the outer bracket member extending perpendicular to the central plane bridging the central plane with the two arm portions of the outer bracket member extending parallel the central plane towards the end of the panel unit, the outer bracket member received in the bight cavity of the inner bracket member with the second end portion and the third end portion of each facing sheet member received in the bight cavity of the inner bracket member intermediate the inner bracket member and outer bracket member, the central bight member of the outer bracket member coupled to the central bight member of the inner bracket member with the third end portion of each facing sheet member in between the central bight member of the outer bracket member and the central bight member of the inner bracket member to securely join the facing sheet members with the first end portions of the facing sheet members at each end of the panel disposed in a common end vertical plane, the arm portions of the outer bracket member extending from the central bight member of the outer bracket member past the first end portion of each facing sheet members for engagement with arm portions of an outer bracket member of a complementary modular panel unit in end to end abutting engaged relation therewith, one arm portion of each outer bracket member comprising a male arm and the other arm portion of each outer bracket member comprising a female arm, wherein a male arm of each outer bracket member engages a female arm of another outer bracket member, the male arm and female arm engagable and disengagable merely by respective movement of the panel units relative one another towards, or away from, each other with their central planes disposed in a common center plane, each of the panel units further comprising a compression member, the compression member drawing the central bight member of the outer bracket member into the central bight member of the inner bracket member in a direction parallel the central plane so as to clamp the third end portion of each facing sheet member between the central bight member of the outer bracket member and the central bight member of the inner bracket member to securely join the facing sheet members with the first end portion of the facing sheet members at each end of the panel unit disposed in a common end vertical plane, each second end portion is parallel the central plane and the two arm portions of each inner bracket member extend parallel the central plane, the inner bracket member having a fair of lateral flange portions, each lateral flange portion extending from an end of a respective one of the arm portions of the inner bracket member remote from the bight member away from the other of the arm portions of the inner bracket member perpendicular to the central plane.

2. A panel construction as claimed in claim 1 wherein on each respective side of the central plane a respective facing sheet member on that side of the central plane has the first end portion in engagement with the central bight member of the inner bracket member, the second end portion in engagement with an arm portion of the inner bracket member, and the third end portion in engagement with a lateral flange portion of the inner bracket member.

3. A panel construction as claimed in claim 2 including a vertical frame member engaging the central bight member of the inner bracket member on an surface of central bight member directed away from the end of the panel unit and opposite to a surface which engages the first end portions of the facing sheet members.

4. A panel construction as claimed in claim 3 wherein the compression member engages the vertical frame member so as to compress between the outer bracket member and the vertical frame member the first end portions of the facing sheet members, and the inner bracket member.

5. A panel construction as claimed in claim 4 wherein:

a plurality of separate, removable compression members are provided, each compression member comprises a threaded fastener, the two arm portions of the outer bracket member extending towards the end of the panel unit defining a bight cavity open toward the end of the panel, each threaded fastener accessible from the end of the panel unit via the bight cavity of the outer bracket member.

6. A panel construction as claimed in claim 1 wherein when the ends of two panel units are in end-to-end abutting engagement with the female arm of each outer bracket member engaged with the male arm of another outer bracket member, the first end portion of each facing sheet member of one panel unit engages the first end portion of each facing sheet member of the other panel unit.

7. A panel construction having a series of upright panel units which abut one another end to end to provide a single line joint therebetween, each of the panel units comprising a pair of spaced facing sheet members located symmetrically on either side of a vertical central plane through the panel unit, with at each end of the panel unit each of an inner bracket member and an outer bracket member, each facing sheet member having a facing sheet portion and vertical edge portions at each end of the panel unit, each facing sheet portion disposed in a plane parallel to the central plane, each vertical edge portions including a first end portion perpendicular to the central plane, a second end portion and a third end portion perpendicular to the central plane, the first end portion extending laterally inwardly from the facing sheet portion toward the central plane to the second end portion which extends away from the end of the panel unit to the third end portion which extends laterally inwardly toward the central plane, the inner bracket member having a U-shaped central portion with a central bight member from which two arm portions extend, the central bight member of the inner bracket member extending perpendicular to the central plane bridging the central lane with the two arm portions of the inner bracket member extending towards the end of the panel unit defining a bight cavity open toward the end of the panel unit, the outer bracket member having a U-shaped central portion with a central bight member from which two arm portions extend, the central bight member of the outer bracket member extending perpendicular to the central plane bridging the central plane with the two arm portions of the outer bracket member extending parallel the central plane towards the end of the panel unit, the outer bracket member received in the bight cavity of the inner bracket member with the second end portion and the third end portion of each facing sheet member received in the bight cavity of the inner bracket member intermediate the inner bracket member and outer bracket member, the central bight member of the outer bracket member coupled to the central bight member of the inner bracket member with the third end portion of each facing sheet member in between the central bight member of the outer bracket member and the central bight member of the inner bracket member to securely join the facing sheet members with the first end portions of the facing sheet members at each end of the panel disposed in a common end vertical plane, the arm portions of the outer bracket member extending from the central bight member of the outer bracket member past the first end portion of each facing sheet members for engagement with arm portions of an outer bracket member of a complementary modular panel unit in end to end abutting engaged relation therewith, one arm portion of each outer bracket member comprising a male arm and the other arm portion of each outer bracket member comprising a female arm, wherein a male arm of each outer bracket member engages a female arm of another outer bracket member, the male arm and female arm engagable and disengagable merely by respective movement of the panel units relative one another towards, or away from, each other with their central planes disposed in a common center plane, wherein when the ends of two panel units are in end-to-end abutting engagement with the female arm of each outer bracket member engaged with the male arm of another outer bracket member, the first end portion of each facing sheet member of one panel unit are spaced a uniform predetermined distance from the first end portion of each facing sheet member of another panel unit forming a uniform vertical gap therebetween on each side of the central plane.

8. A panel construction as claimed in claim 7 wherein the second end portion of at least one facing sheet member have a plurality of vertically spaced slots formed therethrough opening into one of the vertical gaps, the slots adapted to receive hanger brackets for support of components on the panel unit.

9. A panel construction as claimed in claim 1 including a core intermediate the facing sheet portions of the sheet members assisting in supporting the facing sheet portions spaced apart in parallel planes.

10. A panel construction as claimed in claim 1 wherein the outer bracket member having a bight cavity open toward the end of the panel and defined between the arm portions of the outer bracket member and the central bight member of the outer bracket member, the compression member accessible via the bight cavity of the outer bracket member.

11. A panel construction as claimed in claim 1 wherein when the ends of two panel units are in end-to-end abutting engagement with the female arm of each outer bracket member engaged with the male arm of another outer bracket member, the first end portion of each facing sheet member of one panel unit are spaced a uniform predetermined distance from the first end portion of each facing sheet member of another panel unit forming a uniform vertical gap therebetween on each side of the central plane.

12. A panel construction as claimed in claim 11 wherein the second end portion of at least one sheet member have a plurality of vertically spaced slots formed therethrough opening into one of the vertical gaps, the slots adapted to receive hanger brackets for support of components on the panel unit.

* * * * *